United States Patent [19]

Plummer, III

[11] 4,252,258

[45] Feb. 24, 1981

[54] GANG TAPE DISPENSER

[76] Inventor: Walter A. Plummer, III, 14831 Foxcroft, Tustin, Calif. 92680

[21] Appl. No.: 37,753

[22] Filed: May 10, 1979

[51] Int. Cl.[3] ..... B26F 3/02

[52] U.S. Cl. ..... 225/25; 206/394; 225/34; 225/47; 225/78; 225/90; 225/91; 242/55.3

[58] Field of Search ..... 225/38, 34, 78, 47, 225/46, 53, 80, 26, 25, 90, 91; 242/55.3; 206/394

[56] References Cited

U.S. PATENT DOCUMENTS

| | | | |
|---|---|---|---|
| 593,035 | 11/1897 | Springsteen | 225/34 |
| 757,844 | 4/1904 | Scott | 225/38 |
| 1,443,358 | 1/1923 | Gerould | 225/78 |
| 1,632,265 | 6/1927 | Axberg | 242/55.3 |
| 2,708,076 | 5/1955 | Polster et al. | 225/34 |
| 3,217,955 | 11/1965 | Tinkey | 225/78 X |
| 3,502,252 | 3/1970 | Mariani | 225/38 X |
| 3,547,327 | 12/1970 | Mariani | 225/47 X |
| 3,768,713 | 10/1973 | Lash | 225/34 |
| 3,948,455 | 4/1976 | Schwartz | 206/394 X |

FOREIGN PATENT DOCUMENTS

| | | | |
|---|---|---|---|
| 2204799 | 8/1973 | Fed. Rep. of Germany | 225/34 |

*Primary Examiner*—Frank T. Yost

*Attorney, Agent, or Firm*—Sellers and Brace

[57] ABSTRACT

A gang tape dispenser for a multiplicity of dissimilar rolls of pressure sensitive tape selectively usable at the user's option. Each roll may bear a roll of distinctive symbols dissimilar from those on the other rolls enabling the user to employ strips alone or in any of a profusion of combinations for coding and identifying and the like purposes. The tape rolls are housed in aligned storage cells having dispensing ports facing a common severing blade. The dispenser can be bench mounted or suspended on a workman's belt.

13 Claims, 6 Drawing Figures

FIG. 1.
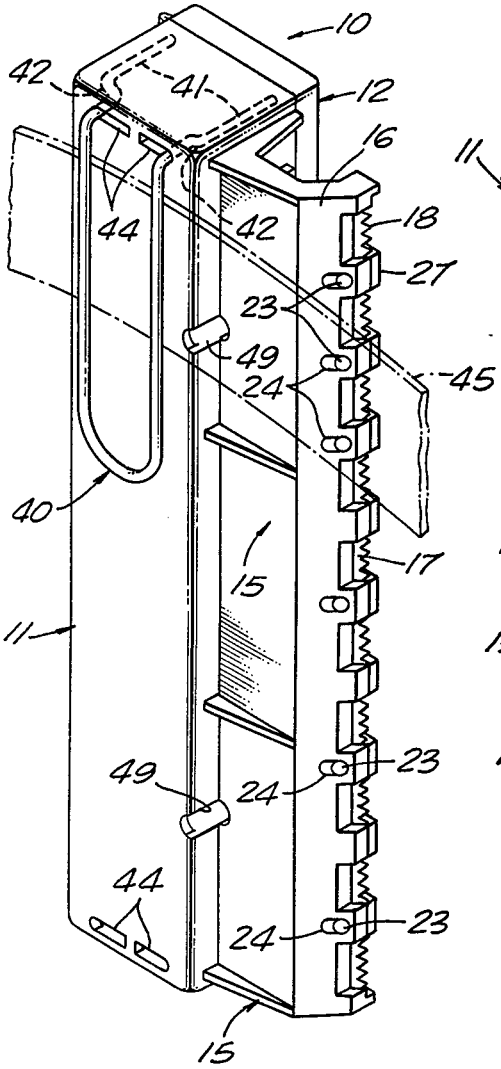
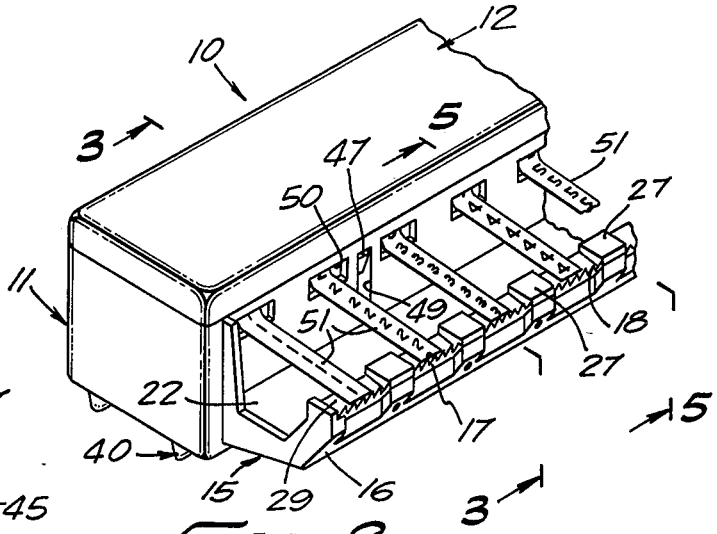
FIG. 2.
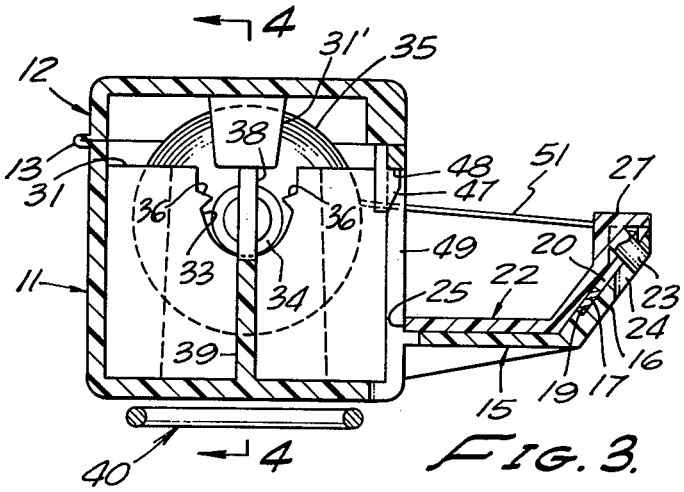
FIG. 3.
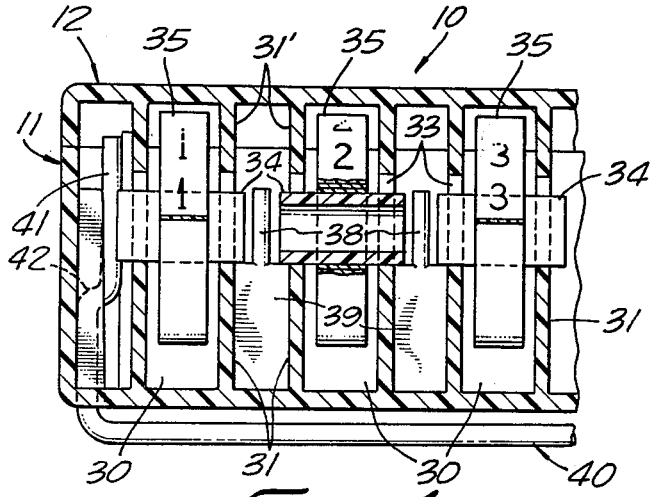
FIG. 4.
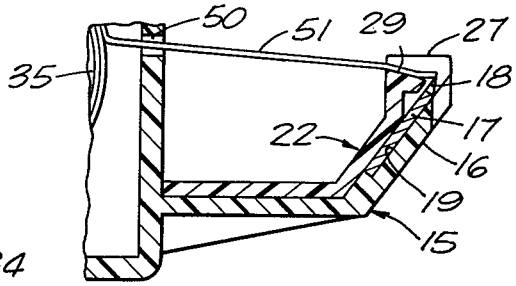
FIG. 5.
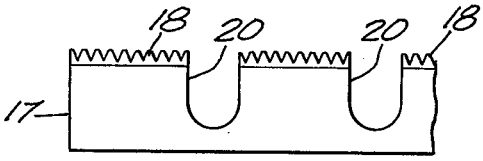
FIG. 6.

GANG TAPE DISPENSER

This invention relates to tape dispensers and more particularly to an improved gang dispenser housing a multiplicity of dissimilar pressure sensitive tapes having many uses as, for example, identifying articles, ducting, cables, and conductors with distinctive code symbols.

BACKGROUND OF THE INVENTION

There have been proposals heretofore to provide a gang tape dispenser as evidenced by the U.S. Patents to Thompson No. 259,438; Rosen No. 1,487,607 and Mariani No. 3,547,327. However, each of these prior constructions is subject to various disadvantages and shortcomings avoided by this invention. Mariani's dispenser is intended for use to serve the same general purposes as my dispenser. However, it is lacking in versatility and requires a multiplicity of separate severance components. There is no provision for clipping the dispenser to a workdman's clothing.

SUMMARY OF THE INVENTION

The foregoing and other shortcomings of prior dispensers are avoided by this invention. The improved gang tape dispenser comprises essentially a one piece housing of tough molded plastic material having a row of storage cells for separate rolls of tape each bearing a row of distinctive symbols or characters, the several rolls being retained captive by a cover having a flexible hinge integral with the housing proper. The combination tape severing ledge and support for the tape ends is spaced forwardly of and extends along the ported face of the housing and includes a common severing blade for all tapes. This replaceable blade is held assembled by a snap-in keeper and guard member. The dispenser is mountable on a work bench or suspendable from a workman's belt by a self-locking spring clip insertable at either end of the housing to accommodate either a right hand or a left hand worker.

These and other more specific objects will appear upon reading the following specification and claims and upon considering in connection therewith the attached drawing to which they relate.

Referring now to the drawing in which a preferred embodiment of the invention is illustrated:

FIG. 1 is a perspective view of an illustrative embodiment of the invention from the underside thereof showing the suspension clip assembled to one end thereof;

FIG. 2 is a fragmentary perspective view of one end of the dispenser showing several of the dissimilar tapes in dispensing position;

FIG. 3 is a cross sectional view on an enlarged scale taken along line 3—3 on FIG. 2;

FIG. 4 is a fragmentary cross sectional view taken along line 4—4 on FIG. 3;

FIG. 5 is a fragmentary cross sectional view on an enlarged scale taken along line 5—5 on FIG. 2; and FIG. 6 is a fragmentary view of one end portion of the severing blade.

Referring more particularly to FIGS . 1 and 2, there is shown an illustrative embodiment of the invention gang tape dispenser, designated generally 10, having an elongated generally rectangular housing 11 provided with a cover 12 molded in one unitary assembly interconnected by a living flexible hinge 13. A plastic composition having high durability impact strength and shatterproof characteristics and sufficiently flexible to provide a living hinge is utilized as, for example, a polypropylene composition available from Eastman Kodak Co., under the trade name Tenite No. 5321 is preferred or a composition having similar properties. Tenite 5321 has a density of 0.896 grams/cc, a Rockwell hardness of 46 on the R scale, a stiffness in flexure of ($10^5$ psi) 0.80 and a tensile strength at yield of 3050 psi.

Integral with and extending along the front face of the dispenser body is an L shaped ledge 15 having an upwardly and outwardly inclined leg 16. A single tape severing blade 17 extends the full length of ledge 15 and is provided with sharp severing teeth 18 and a plurality of deep notches 20. Blade 17 is seated in a rabbet recess 19 along the inner face of leg 16 and is held firmly but detachably therein by an L-shaped molded plastic keeper 22 extending substantially the full length of ledge 15. This keeper is shaped to mate with and conform to the upwardly facing surface of ledge 15. Projecting downwardly and outwardly from the upper portion of its upright leg are a plurality of bosses 23 best shown in FIGS. 1 and 3. These bosses are positioned to extend through the cutouts or notches 20 in the severing blade and into elongated openings 24 formed in leg 16.

The assembly operation of blade 17 and keeper 22 is accomplished by inserting the blade in rabbet 19 and then tilting the longer left hand edge of the keeper, as viewed in FIGS. 3 and 5, so as to insert bosses 23 into openings 24. Thereafter the keeper is rotated counter clockwise until its innermost edge 25 seats against the junction of the front face of the tape housing with the horizontal leg of ledge 15. When in the fully assembled position, edge 25 has a firm frictional fit with the adjacent face of the housing wall and bosses 23 are held pressed against the upper end of the receiving openings 24, thereby locking blade 17 firmly in its assembled operating position.

As is best shown in FIGS. 2, 3 and 5, the upper edge of keeper 22 is provided with rectangular tangs 27 which extend over and conceal portions of teeth 18 of the severing blade while leaving short sections of teeth 18 exposed for engagement with an associated roll of tape stored within the dispenser. It will be understood that either moisture or pressure sensitive adhesive may be used on tape 35, and that the term gummed is intended as generic to both types of adhesive. The portion of keeper 22 between adjacent flanges 27 includes a downwardly and forwardly shelf 29 (FIG. 5) which lies generally in a plane slightly above the upper edge of teeth 18. Thus the surface of this shelf is inclined downwardly and forwardly toward these teeth for a purpose which will be explained more fully presently.

Referring now more particularly to FIGS. 3 and 4, it is pointed out that the interior of the main body of the dispenser is divided into tape storage cells 30, 30 by upright partitions 31. These partitions are deeply notched at 33 to seat short tubular shafts 34 each supporting an individual roll of pressure sensitive tape 35. Shafts 34 are held loosely captive in notches 33 by downwardly extending flanges 31' integral with the interior wall of cover 12. Desirably, shafts 34 are additionally retained captive by an interference fit with ears 36 projecting toward one another from the opposite edges of notches 33. Ears 36 may be formed after the main housing has been removed from the mold by upsetting the edges of notches 33 with a suitable heated forming tool. This tool is pressed downwardly from the entrance edge of the notches softening the plastic material and deforming it into the ear configuration shown at 36. Shafts 34 are held against excessive endwise movement by separator bosses 38 (FIGS. 3 and 4) projecting upwardly from the upper edge of stiffening webs 39 (FIGS. 3 and 4) integral with partitions 31.

Dispenser 10 may be mounted on a workbench in a generally horizontal position. Alternatively, the dispenser may be suspended from either end by means of a resilient spring clip 40. Clip 40 is generally U-shaped and the upper end portions 41 of its legs may be bent to lie in a plane normal thereto. Portions 41 are also offset from one another as clearly indicated in FIG. 1 to provide shoulders 42 which interlock with the interior corners of the main housing.

Portions 41, 42 of the suspension clip are insertable through elongated openings 44 in the bottom of the dispenser while the legs of the clip are held collapsed toward one another. After insertion, portions 41, 42 expand until offsets 42 engage the adjacent interior portions of the housing to retain the clip firmly but detachably in assembled position. It will be noted that there are separate pairs fo openings 44 at the opposite ends of the bottom wall of the housing thereby enabling the user to insert the clip in either one or the other pair of openings 44 to support either end of the dispenser upwardly from the workman's trouser belt 45. Right handed workers prefer to have the dispenser suspended along one leg whereas left hand workmen prefer to suspend the dispenser from the other end along the left leg.

The dispenser cover 12 is held closed by the notched latching tangs 47 (FIG. 3) which project downwardly from the forward lip edge of the cover and engage detents 48 at the upper edge of notches 49 (FIGS. 1, 2). Notches 49 extend downwardly through the bottom of the housing in order that a rod, screwdriver or other tool can be inserted upwardly therethrough to disengage tangs 47, thereby releasing cover 12 and permitting access to the interior of the dispenser.

The front wall of the dispenser is provided with tape dispensing slots or ports 50 (FIG. 5) through which the free ends of the tape 51 are threaded and pressed against the shelves 29 carried by the upper edge of keeper 22. As illustrated in FIG. 2, each of the rolls of tape 35 are imprinted or otherwise distinguished from one another by closely spaced distinctive symbols or digits. As shown in FIG. 2, the symbols carried by the 10 dissimilar tapes are the numerals 0, 1, 2, 3, 4, 5, 6, 7, 8 and 9. In other words, the illustrated dispenser had ten storage comparts for ten dissimilar rolls of tape 35. It will be understood that other symbols or combinations of symbols may be carried by the different tapes.

In use, an article to be identified or coded can be marked by a short length of tape severed from any one or more of the tapes. For example if a conductor were to be identified as number 521, the operator first detaches a short length from roll 5 and wraps this length about the conductor. Thereafter, he similarly applies a length of "2" tape and then a length of "1" tape.

Although the tapes shown are impressed with numerals it will be understood that the tapes may be distinguished from one another by various other means as by different colors, letters or symbols as well as by various colors of tapes imprinted with various symbols.

While the particular gang tape dispenser herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A gang tape dispenser for dispensing any one of a multiplicity of rolls of gummed tape, comprising;

an elongated hollow main body having the interior thereof divided into a row of side-by-side cells each adapted to store and retain a single roll of gummed tape;

a tape dispensing port in the front wall of said main body for each tape storing cell;

means for holding the free end of each tape captive and including a severing blade common to all of said rolls of tapes for severing addispensed length of tape from any selected one of said multiplicity of tape storing cells; and suspension means for suspending said dispenser from a belt secured about a workman comprising U-shaped spring wire clip means having the end portions of the legs thereof lying generally normal to a plane through the remainder of said legs, said end portions being deformed to form detents engageable with the interior of said main body to hold said clip assembled thereto.

2. A gang tape dispenser as defined in claim 1 characterized in the provision of separator means for maintaining a roll of tape in any cell spaced a predetermined distance from a roll of tape in an adjacent cell.

3. A gang tape dispenser as defined in claim 1 characterized in the provision of a unitary severing blade retainer means embracing portions of said severing blade means between the edges of adjacent one of said tapes to protect the user of said dispenser from injury from said blade means while severing a dispensed length of tape.

4. A gang tape dispenser as defined in claim 3 characterized in that said severing blade retainer means is detachable as a unit from said tape holding means.

5. A gang tape dispenser as defined in claim 1 characterized in that one sidewall of said main body is provided with a pair of elongated openings sized to receive said end portions of said wire clip and to engage said detents after insertion through said openings and thereby releasably lock said clip assembled to said dispenser.

6. A gang tape dispenser as defined in claim 5 characterized in that said one sidewall of said main body is provided with a second pair of elongated openings similar to said first pair and selectively usable to receive said suspension clip thereby to suspend said dispenser in the alternate upright position at the user's option.

7. A gang tape dispenser comprising:

an elongated one-piece plastic housing sub-divided crosswise thereof into a multiplicity of spaced apart tape roll storage cells by partitions integral with said housing each having notch means in one edge for rotatably supporting a shaft-equipped roll of pressure sensitive tape in each of said cells each bearing a row of symbols differing from the symbols of other of said rolls of tape;

common cover means closing an access opening in said housing for each of said storage cells and attached to said housing by an integral flexible plastic hinge of thinner cross-section than said housing and said cover means; and said one-piece housing including a unitary L-shaped ledge means integral therewith and spaced forwardly of said storage cells and provided with severing means for severing a dispensed length of tape from a tape roll stored in any one of said cells, said ledge means including retainer means for said tape severing means having an exposed surface positioned to be contacted by said pressure sensitive tape to hold the foremost end of each roll of tape captive until deliberately released.

8. A gang tape dispenser as defined in claim 7 characterized in that said tape severing means comprises a sharp toothed blade extending substantially from end-to-end of said L-shaped ledge means.

9. A gang tape dispenser as defined in claim 8 characterized in that said retainer means comprise an L-shaped snap-in member overlying and seated against said L-shaped ledge and cooperating therewith to hold said tape severing means detachably assembled to said ledge means.

10. A gang tape dispenser as defined in claim 7 characterized in the provision of cooperating detent and plastic latch means mounted respectively on said housing and on said cover means operable to hold said cover means normally closed across the access opening to said tape storage cells.

11. A gang tape dispenser for dispensing tape from any one of a multiplicity of rolls of tape coated with pressure sensitive adhesive and mounted on shaft means projecting from either end of each roll, comprising:

a one-piece elongated plastic housing subdivided crosswise thereof by parallel planar partitions to form a separate tape storage cell for each roll of tape, the mid-portion of the upper edge of said partitions being notched to seat one end of said shaft means, and said notches having ear means positioned and effective to hold said shaft means releasably captive when pressed therepast into the bottoms of said notches:

said housing having an L-shaped ledge extending lengthwise thereof with one leg integral with one sidewall of said housing and with its other leg extending upwardly and outwardly from the outer end of said one leg;

means securing a single tape severing blade along the upper edge of said other leg of said L-shaped ledge.

the sidewall of said housing having a tape dispensing opening from each of said tape storage cells; and said housing including a cover overlying each of said tape storage cells and attached thereto by an integral hinge of thinner plastic than the plastic of said cover and housing.

12. A gang tape dispenser as defined in claim 11 characterized in that said severing blade securing means comprises one-piece snap-in plastic retainer means overlying and resting snugly against said L-shaped ledge and having portions thereof in pressurized engagement with cooperating openings in said ledge when assembled thereto.

13. A gang tape dispenser as defined in claim 12 characterized in that said snap-in plastic retainer means includes a generally flat surface closely beside the serving edge of said blade and positioned to be brought in pressure contact with the tape adhesive as a dispensed portion of the tape is being severed by said blade and thereby effective to hold the tape captive until the next dispensing operation.

* * * * *